United States Patent [19]

Ferrero

[11] Patent Number: 5,016,421

[45] Date of Patent: May 21, 1991

[54] WRAPPING MACHINE, PARTICULARLY FOR SWEETS AND SIMILAR FOOD PRODUCTS

[75] Inventor: Pietro Ferrero, Brussels, Belgium

[73] Assignee: Ferrero S.p.A., Alba, Italy

[21] Appl. No.: 527,405

[22] Filed: May 23, 1990

[30] Foreign Application Priority Data

May 24, 1989 [IT] Italy ..... 67394 A/89

[51] Int. Cl.[5] ..... B65B 11/34

[52] U.S. Cl. ..... 53/233; 53/227; 53/234; 53/370

[58] Field of Search ..... 53/233, 234, 225, 370, 53/228, 227

[56] References Cited

U.S. PATENT DOCUMENTS

| | | | |
|---|---|---|---|
| 2,243,633 | 5/1941 | Jones | 53/233 X |
| 2,744,370 | 5/1956 | Seragnoli | 53/370 X |
| 3,131,522 | 5/1964 | Latini | 53/370 X |
| 3,899,865 | 8/1975 | Revaz | 53/225 X |
| 4,352,265 | 10/1982 | Hansel | 53/23 X |
| 4,768,639 | 9/1988 | Gamberini | 53/225 X |
| 4,866,912 | 9/1989 | Deutsch | 53/233 X |
| 4,918,901 | 8/1990 | Gamberini | 53/234 |

FOREIGN PATENT DOCUMENTS 1529212 6/1967 France .

OTHER PUBLICATIONS

European Search Report on European Patent Application No. EP 90 83 0230.

*Primary Examiner*—John Sipos

*Attorney, Agent, or Firm*—Rothwell, Figg, Ernst & Kurz

[57] ABSTRACT

The machine comprises essentially a substantially belt-like endless conveyor provided with plates having cells to which the bodies to be wrapped are supplied individually. The cells with the bodies housed therein are covered by a wrapping sheet which is supplied continuously and is subsequently cut to form an individual wrapping sheet portion for each body. The unit constituted by each body and its respective wrapping sheet portion is turned over and transferred by a thrusting action exerted on the body to a drum provided with gripping jaws and associated folding members. An intermediate, generally tubular wrapper with two end parts and a central part in which the body is situated is thus formed. The two end parts are acted on by rotary pincers provided with pairs of clamping fingers for forming bow-like twists in the ends.

The preferred application is for wrapping food products such as sweets and the like.

3 Claims, 7 Drawing Sheets

WRAPPING MACHINE, PARTICULARLY FOR SWEETS AND SIMILAR FOOD PRODUCTS

DESCRIPTION

1. Field of the Invention

The present invention relates to wrapping machines for wrapping bodies, such as, for example, sweets or similar food products, in wrappers with bow-like twisted ends.

2. Background and Prior Art

In the manufacture of these machines, which are widely known in the trade and have to operate at ever-increasing rates in order adequately to satisfy increasing production requirements, it is necessary to take account of the existence of intrinsic limits imposed by the presence of moving parts (which are subject to wear to a greater or lesser extent) and by the interaction of these parts with the products being wrapped and with the sheet wrapping material which may break if subjected to stresses that are too violent.

Thus, a wrapping machine which operates completely satisfactorily at a rate of, for example, 200 pieces ("strokes") per minute cannot generally operate satisfactorily at the higher rates of the order of 400, 600 or even 1000 strokes per minute which are demanded by current production requirements.

The object of the present invention, therefore, is to provide a wrapping machine which can operate at very high rates (of the order of 1000 strokes per minute) without adverse effects in terms of the wear of the machine or in terms of the risk of breakage of the bodies being wrapped and/or of the wrapping material.

According to the present invention, this object is achieved by virtue of a wrapping machine having the characteristics specified in the claims which follow.

BRIEF DESCRIPTION OF THE DRAWINGS

The invention will now be described purely by way of non-limiting example, with reference to the appended drawings, in which.

DETAILED DESCRIPTION OF THE PREFERRED EMBODIMENT

Figure 1:
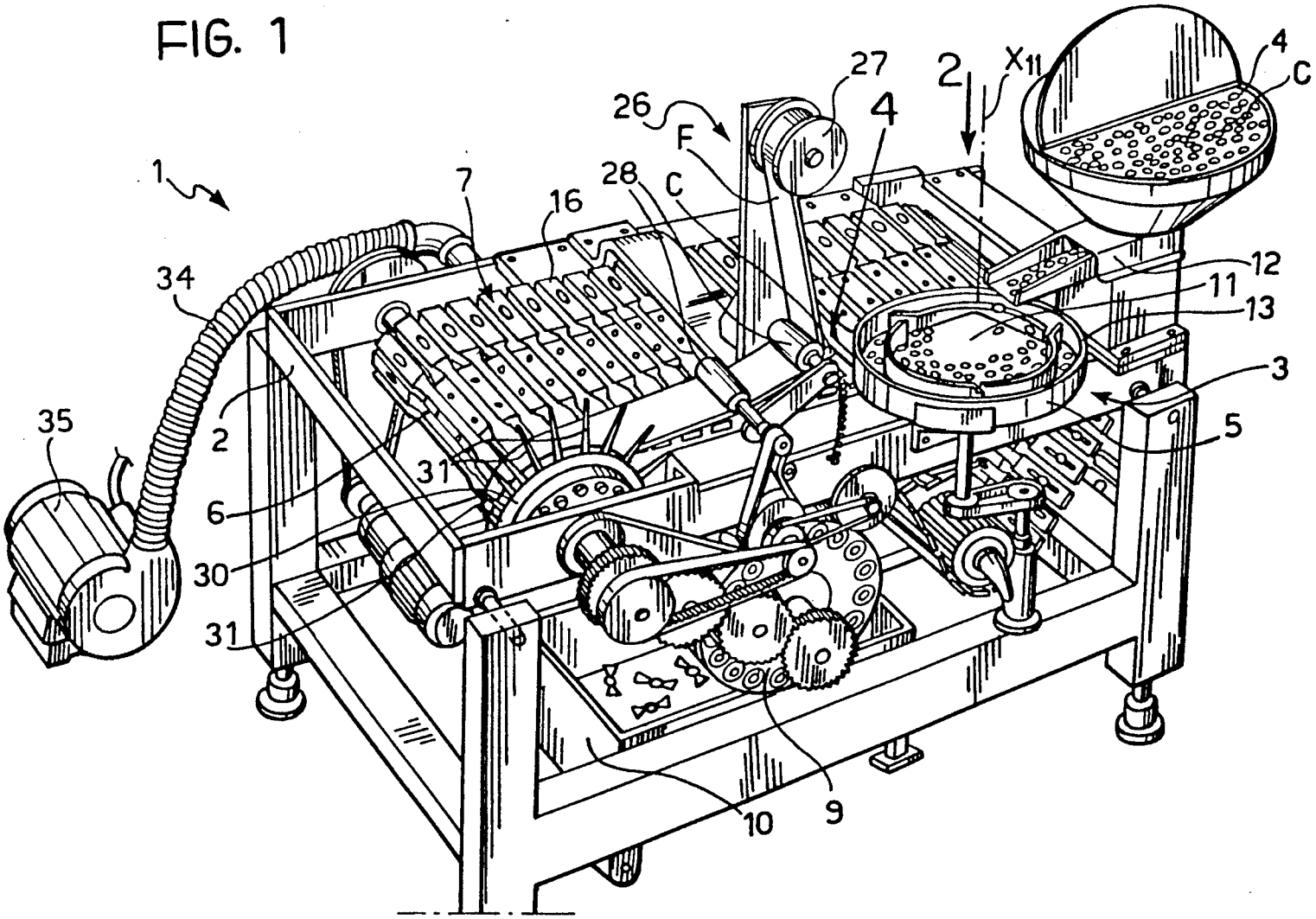
FIG. 1 is a general perspective view (partially cut away for ease of illustration) of a wrapping machine according to the invention.

In the drawings, and particularly in FIG. 1, a wrapping machine, generally indicated 1, is intended for use in wrapping small spherical or ellipsoidal bodies such as, for example, sweets C in wrappers each comprising a central part which surrounds the sweet and two bow-like twisted end parts.

The machine 1 is mounted on a frame 2 and comprises essentially three main units or work stations, that is:

a supply unit 3 comprising a hopper 4 for supplying the sweets, situated above a rotary distributor 5, an endless conveyor unit 6 constituted essentially by a type of motor-driven belt with an upper pass 7 extending horizontally beneath the distributor 5 and a lower return pass 8, and a further carousel or drum element 9 with a horizontal axis 9 arranged in the lower part of the machine and having the function of closing the wrappers so that the wrapped sweets C can fall into a box 10 situated beneath the machine 1.

In the embodiment illustrated in the drawings, which is the one preferred at present, the width or breadth of the belt conveyor 6 is double that necessary for operation with a single supply station 3 and a single wrapping drum 9.

The conveyor can therefore serve, in parallel and in an identical manner, two supply stations 3 and two wrapping drums 9 operating in parallel.

For clarity of illustration, however, the rest of the description and the corresponding drawings refer to the use of a single supply station 3 and a single wrapping drum 9. It is intended, however, that similar functional elements can be provided in a generally symmetrical arrangement in the part of the machine 1 which is shown in the background in FIG. 1.

Figure 2:
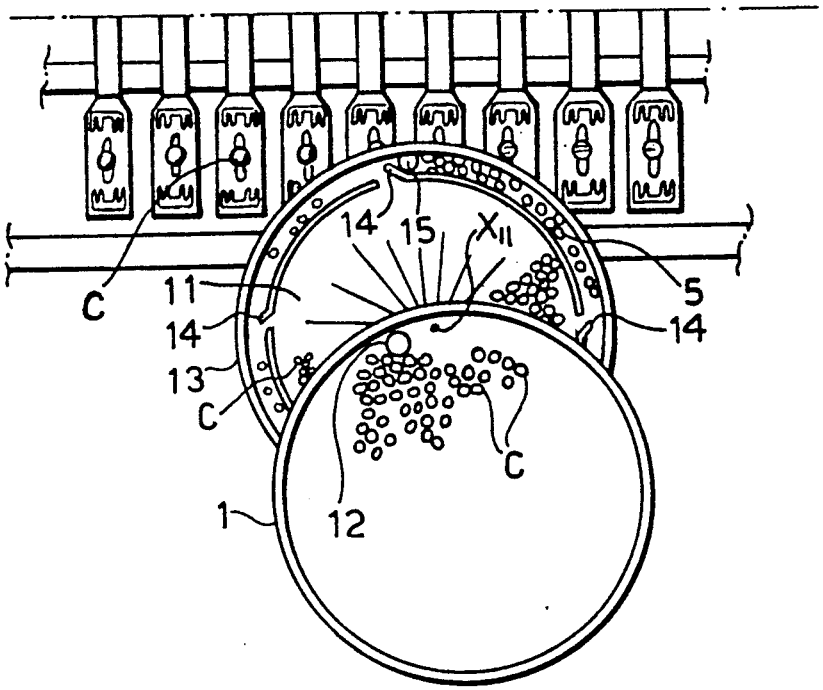
FIG. 2 is a view taken on the arrow II of FIG. 1.

If the structure of the supply station 3 is now examined in detail, it can be seen (see also FIG. 2) that the distributor 5 is constituted substantially by a rotary device 11 which has a vertical axis and is shaped like a very shallow cone whose axis of rotation $X_{11}$ is slightly offset from the delivery opening 12 of the hopper 4.

The sweets C therefore fall into the conical device 11 in an eccentric position and tend to slide around the wall of the device towards a fixed peripheral wall 13 of the distributor 5.

The peripheral wall 13 carries a set of deflector elements 14 on its inner surface and their function is essentially to spread out the sweets C so that they tend to be arranged in a row close to the peripheral wall 13 and arrive in order at least one expulsion hole 15. The sweets C fall through this hole, as through a trap-door, onto the upper pass 7 of the conveyor 6 situated immediately below.

More specifically, with reference to the arrangement of FIG. 1, the conical device 11 of the distributor 5 is rotated in an anticlockwise sense and the conveyor 6 is moved so that, theoretically, its upper pass 7 advances from right to left towards the observer in FIG. 1.

Figure 4:
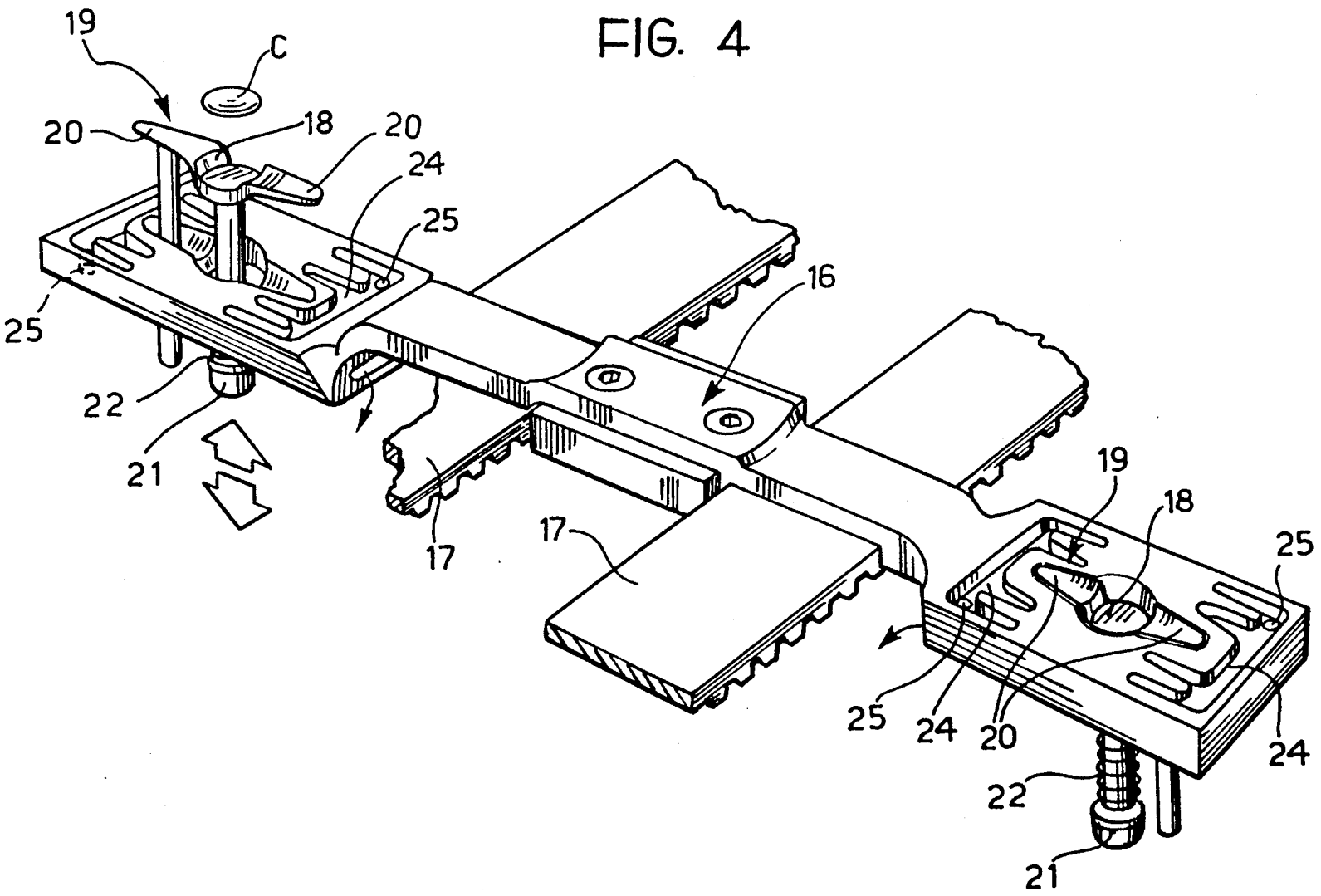
FIG. 4 shows, in greater detail, the structure of the element indicated by the arrow IV of FIG. 1.

As stated, the conveyor 6 is generally belt-like, being constituted by a plurality of plates 16 fixed to flexible loop elements (belts) in the arrangement shown in greater detail in FIG. 4.

Each plate of the conveyor 6 has at least one cell 18 forming a seat for housing a sweet C which falls from the distributor 5.

As already stated above, the appended drawings relate to a conveyor 6 which can operate with two supply stations 3 in parallel.

The plate 16 shown therefore has two cells 18 arranged at opposite ends of the plate 16.

Each cell 18 is defined by a recess in the top of a movable device 19 which has two side flanges 20. These flanges extend generally longitudinally of the plate 16 (that is, perpendicular to the direction of advance of the conveyor 6) from the region forming the cell 18.

The device 19 is movable in the direction of expulsion from the plate 16 takes place (that is, outwardly of the outer surface of the conveyor 6) as a result of the action exerted by corresponding cam means (not shown specifically in the drawings) on a respective thrust member 21 against the biassing action of a spring 22 which tends to return the device 19 automatically to a retracted position relative to the plate 16.

The ends of the plate 16 are also formed with comb-like (labyrinthine) grooves 24 which surround the cells 19 and communicate with a suction (vacuum) source through respective holes 25 (according to criteria which will be described further below).

A supply device 26 is provided in a position generally above the pass 7 of the conveyor 6 and the sheet wrapping material F (for example, paper or various plastics materials) in which the sweets C are to be wrapped is unwound substantially continuously thereby from a roller 27.

The wrapping sheet F is applied to the upper pass 7 of the conveyor 6 by means of a set of transmission rollers, generally indicated 28, so as to cover the sweets C in the cells 18.

Immediately downstream of the position at which the wrapping sheet F is laid on the conveyor 6 to close the cells housing the sweets C (that is, in correspondence with the end return roller 29 of the conveyor 6), there is a rotary cutting unit 30 constituted by a carousel with a horizontal axis provided with a plurality of scissor elements 31 on its periphery and aligned with the spaces between successive plates 16 of the conveyor 7.

Each scissor element 31 comprises two arms or blades. The two blades of the scissor elements 31 are moved (according to criteria which are known and do not, therefore, need to be described in detail) by cam means carried by the frame of the machine 1 so that the blades, which initially are apart when the scissor element is raised towards the upper arm 7 of the conveyor 6 as a result of the rotation of the cylinder 30 (anticlockwise with reference to FIG. 3), are closed onto the wrapping sheet F when the scissor element reaches the region in which the wrapping sheet F lies on the conveyor 6.

The function of the rotary cutting unit 30 is to divide the sheet F into a plurality of successive sections or portions, each of which is intended to wrap a respective body C.

The intake openings 32 of a suction unit extend in correspondence with the cutting unit 30 (that is, in correspondence with the loop part of the conveyor 6) and for a certain distance downstream thereof as far as the wrapping drum 9, the suction unit acting inwardly of the path of the conveyor 6 through an intake manifold 33 connected to a suction pump member 35, which is usually situated outside the machine, by means of a duct 34.

The intake openings 32 of the suction unit are formed so as to achieve a certain degree of sealing relative to the plates 16 of the conveyor 7.

In particular, the intake openings 32 communicate, through the holes 25, with the labyrinthine recesses 24 provided in each plate 16 around the cells 18 which house the sweets C.

The overall effect of this suction configuration is to create a subatmospheric pressure (a vacuum) in the labyrinthine recesses 24 so that the sheet F, which has been divided by the rotary unit 30 into individual portions for wrapping single bodies C, remains in contact with the plates 16 of the conveyor 7 to keep the sweets C safely in the cells. 18.

The correct positioning of each sweet C exactly in the centre (or in any other determined position) of the corresponding portion of wrapping sheet is thus ensured.

In fact, the sweet C is housed in the cell 18 whose open side is closed by the respective portion of wrapping sheet which in turn is kept in contact with the plate 16 as a result of the suction exerted by the source 35 through the duct system 32 to 34.

This correct positioning could not generally be achieved by the deposition of the sweets C on the wrapping sheet F, at least at the operating rates envisaged for the machine according to the invention. Since each portion of wrapping sheet F is several centimeters long in the direction of advance of the conveyor 6, an operating rate of the order of 1000 strokes per minute corresponds to a speed of linear advance of the conveyor 6, of the sheet F and of the bodies C of the order of some tens of meters per minute.

In correspondence with the drum 9, the lower pass 8 of the conveyor 6 bends downwardly so as to extend around a certain angular portion (of the order of 40°-50°) of the upper part of the drum 9. The latter rotates about a respective horizontal axis with a peripheral velocity exactly equal to the speed of advance of the conveyor 6 with phase or position synchronisation (which can be achieved by means of a mechanical coupling) such that the movable devices 19 defining the cells 18 which house the bodies C can be thrust outwardly of the conveyor 6 (by cam means, not shown, and according to criteria which will described further below) in order to transfer the bodies C and their respective portions of wrapper towards corresponding receiving cells in a generally carousel-like structure on the drum 9.

Figure 5:
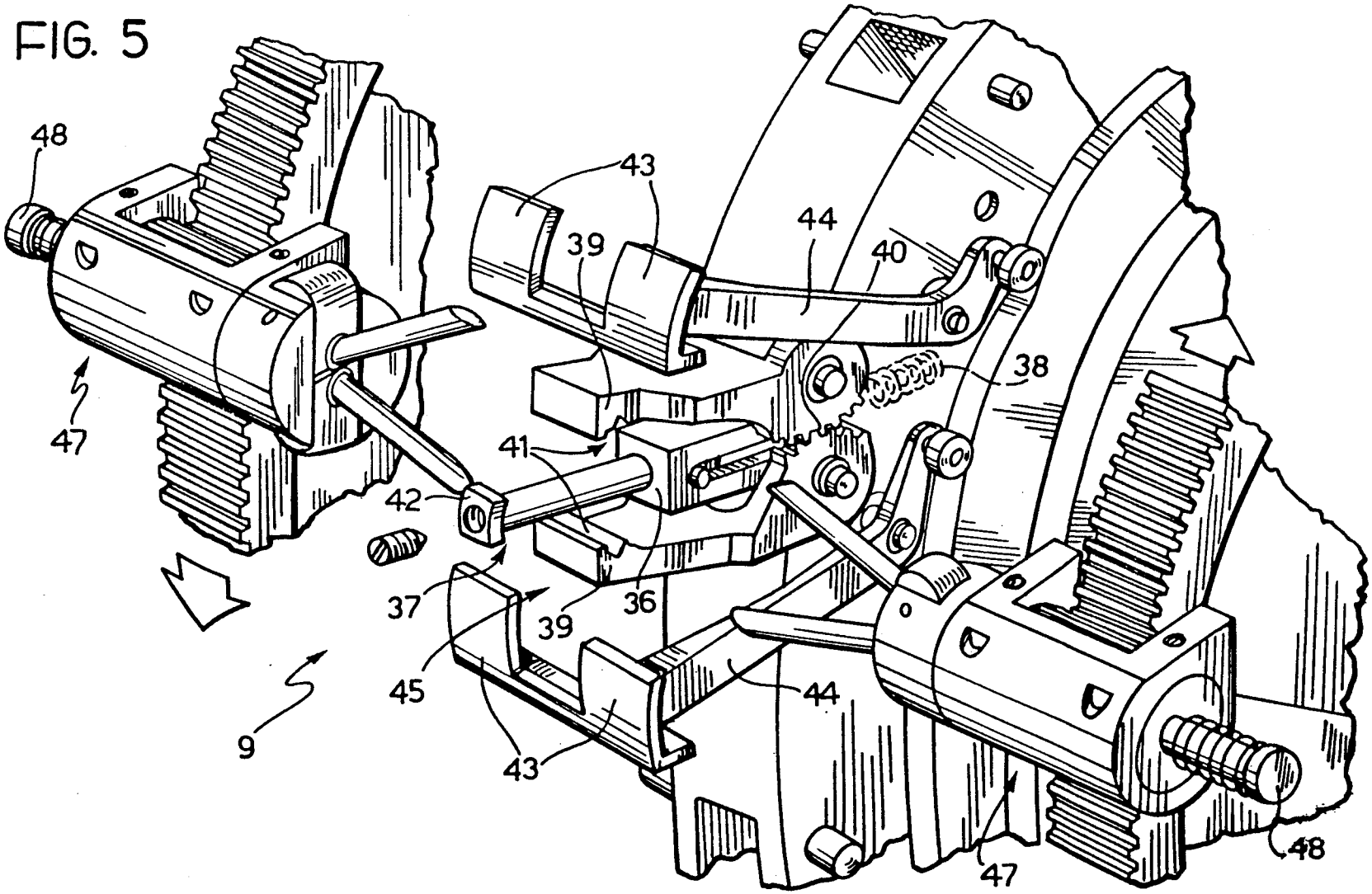
FIG. 5 shows, in greater detail, the structure of the part of the machine indicated by the arrow V of FIG. 3, FIGS. 6 to 11 show, by way of example, a sequence of operating stages of the machine according to the invention.

Each of the receiving cells has the structure shown in FIG. 5.

In this drawing, a core or central pin, indicated 36, is mounted in a fixed position relative to the drum 9 so as to extend radially of the drum 9.

A thrust piston 37 is slidable axially in the core 36 and is urged radially outwardly of the drum 9 by the action of a biassing spring 38. Two pivoting jaws, indicated 39, can be opened and closed in a coordinated manner by virtue of an angular coupling achieved by means of meshed toothed sectors 40. More precisely, the jaws pivot in opposite directions so as to move respective free ends 41 provided with gripping grooves (for example, V-shaped grooves opening inwardly of the clamping region) tangentially towards and away from the drum 9 in the region immediately facing the free end of the core 36, that is, in the region occupied by the head 42 of the thrust member 37 in its position of maximum retraction into the core 36

A further pivoting element, indicated 43, is constituted essentially by a slightly arcuate, tile-shaped plate mounted on the end of a pivoting arm 44 which is fixed to the structure of the drum 9 so that it can perform a movement approximately corresponding to that of one of the jaws 39.

Figure 3:
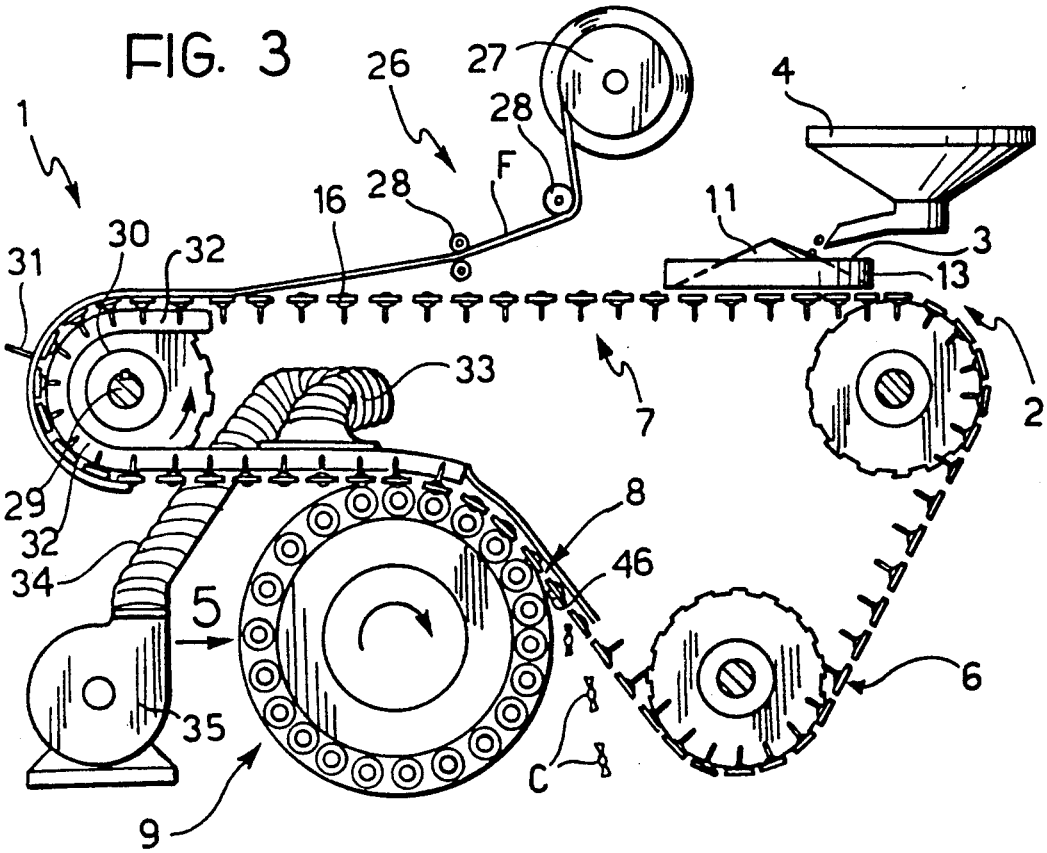
FIG. 3 is a side elevation of a machine according to the invention, from which some component parts have been omitted for clarity of illustration.

More precisely, taking account of the fact that the drum 9 rotates in a clockwise sense with reference to the observation point of FIG. 3, the elements 43 shown in FIG. 5 can be thought of as moving upwards.

Each pair of facing jaws 39 thus includes a downstream jaw and an upstream jaw (the upper and lower jaws in FIG. 5 respectively), the free end of the latter being surrounded by the plate of the pivoting element 43.

The latter is intended to act as a wrapper-folding element and can move essentially between a retracted position (shown in FIG. 5) in which it is substantially disengaged from the corresponding jaw 39, and an advanced or raised position (described further below) in which the element 43 projects towards the gripping region of the jaws 39 so as to cooperate with the bodies C and their respective wrappers which are gripped between the jaws 39.

The plate of the movable folding element 43 has a central U-shaped notch 45 so as not to interfere with the corresponding jaw 39.

A plate element, indicated 46 in FIG. 3, is intended to fulfil a function complementary to that of the movable folding elements 43, according to criteria which will be described further below.

The element 46 is constituted by a generally tile-shaped plate arranged generally downstream of the region in which the bodies C and their respective portions of wrapper are transferred from the conveyor 6 to the wrapping drum 9.

The element 46, which also acts as a wrapper-folding device, is mounted in a fixed position relative to the frame of the machine 1.

Two wrapping pincers or hands, indicated 47, are arranged on opposite sides of the jaws 39 on a generatrix of the drum 4 which extends through the gripping region of the jaws 39.

The pincers or hands 47 are provided with corresponding operating thrust elements 48 and respective drive gears 49. The latter enable the pincers to perform a coordinated rotary motion about an axis coinciding with the said generatrix of the drum 9, according to criteria which will be described further below.

In general, all the pivoting and/or translating members described hitherto, such as:

the movable devices 19 defining the cells 18 and driven by the thrust members 21, the scissor elements 31 of the rotary cutting unit 30, the jaws 39 of the receiving cavities of the drum 9, the pivoting folding devices 43, and the pincers or hands 47, as regards both the operation of the thrust members 48 and the rotation of the drive gears 39, are driven in synchronism with the advance of the conveyor 6 and the drum 9 by cam elements of known type mounted on the frame 2 of the machine 1.

In general, the cam elements are not visible in the appended drawings since their detailed representation conflicts with the need to show clearly the arrangement and the laws of movement of the movable parts described above. The production of such cam elements, however, constitutes a design task fully within the capabilities of an expert in the art: a detailed description thereof is therefore wholly superfluous since it is completely irrelevant to the understanding of the invention.

Figure 6:
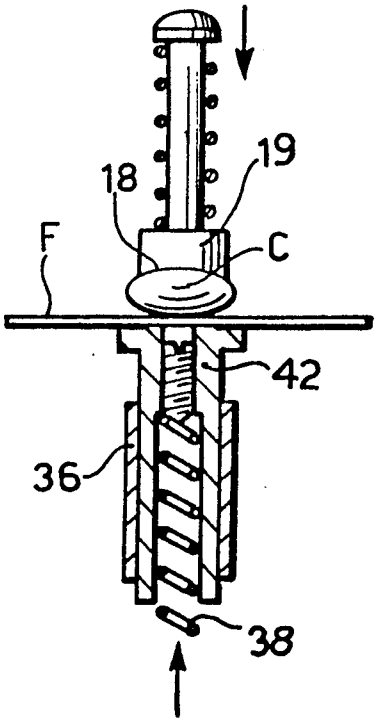

FIG. 6 shows schematically the situation in which one of the devices 19 projects downwardly, that is, outwardly of the path of the conveyor 6, where the lower pass 8 of the conveyor 6 starts to pass around the drum 9. The device 19 therefore thrusts the body C situated in its cell 18 and covered by a respective portion of the wrapping sheet F downwardly, that is, towards the drum 9, pushing a corresponding thrust member 37 against the force of its biassing spring 38.

This expulsion movement leads to the transfer of the unit formed by the body C and its respective portion of wrapping sheet F from the conveyor 6 to the drum 9. The movement in question takes place as a result of the insertion of the unit formed by the body C and the wrapping sheet F in the jaws 39 flanking the thrust member 36 with a consequent U-shaped folding of the portion of the wrapping sheet F.

This general folding into a U-shape is facilitated by the presence of the appendages 20 (FIG. 4) at the sides of the cell 18.

Figure 8:
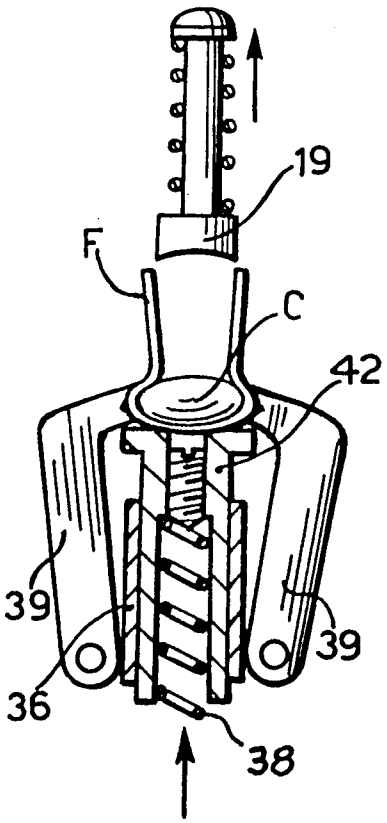
Figure 7:
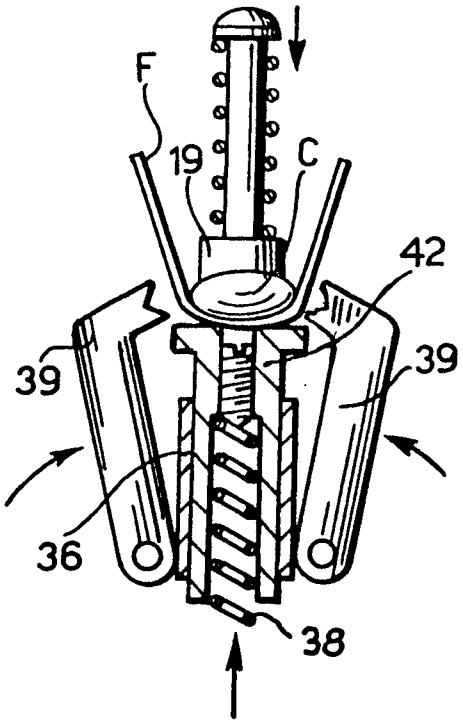

The formation of a U-shape in the wrapping sheet F starts at the stage shown in FIG. 7 and continues during the stage shown in FIG. 8, in which the jaws 39 are clamped around the sides of the body C with the interposition of the wrapping sheet F, whilst the movable device 19 gradually returns upwardly (that is, inwardly of the conveyor 6) as a result of the biassing of the spring 22.

Figure 9:
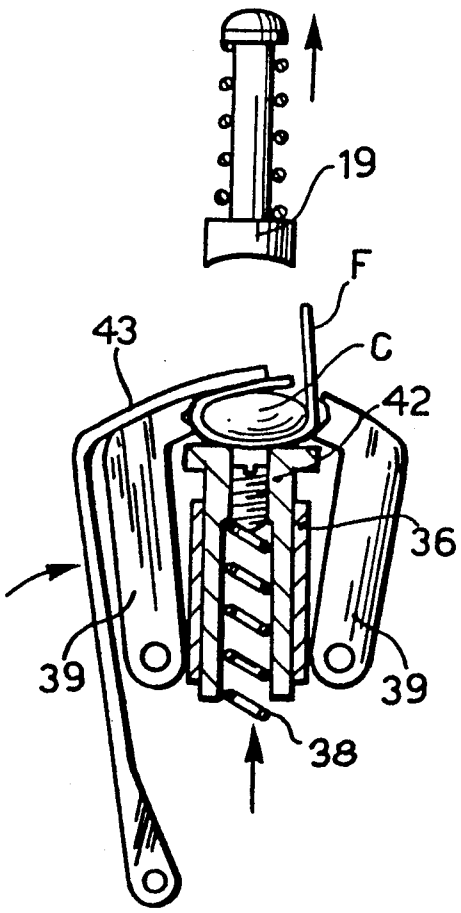

As soon as the movable device 19 has been retracted, the folding element 43 comes into operation and pivots towards the body C which is clamped between the jaws 39 so as to fold one of the two flaps of the wrapping sheet F against the body C (FIG. 9).

Figure 10:
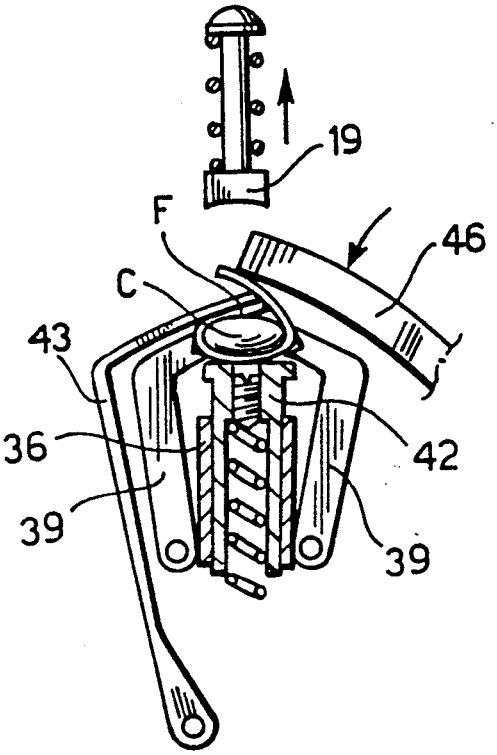

The wrapping operation continues during the stage shown in FIG. 10, in which, as a result of the gradual rotation of the drum 9, the unit constituted by the jaws 39 and the body C clamped between them (already partially wrapped in the sheet F as a result of the action of the element 43) reaches the other folding element 46. This acts on the opposite flap of the wrapping sheet F, folding it onto the body whilst the folding element 43 returns to its rest position, shown in FIG. 5.

It will be appreciated that the movable folding element 43 is situated, so to speak, upstream of the clamping region of the jaws 39 whilst the fixed folding element 46 is encountered by the body C and the wrapping sheet F as a result of their gradual movement downstream towards the output of the machine.

Figure 11:
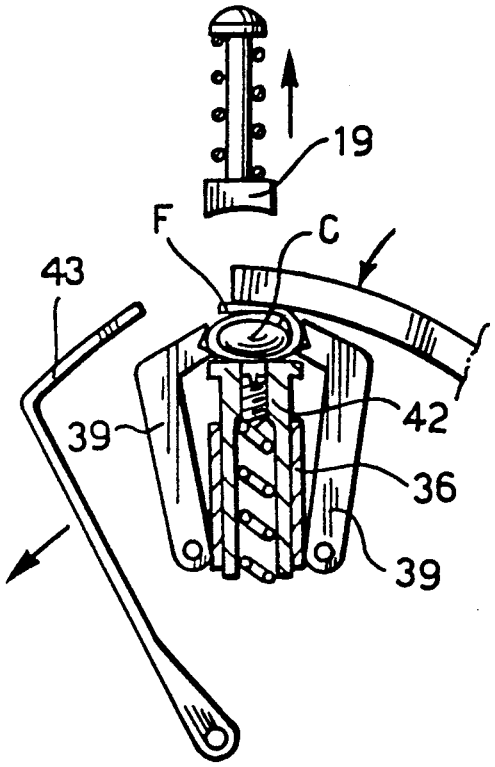
Figure 14:
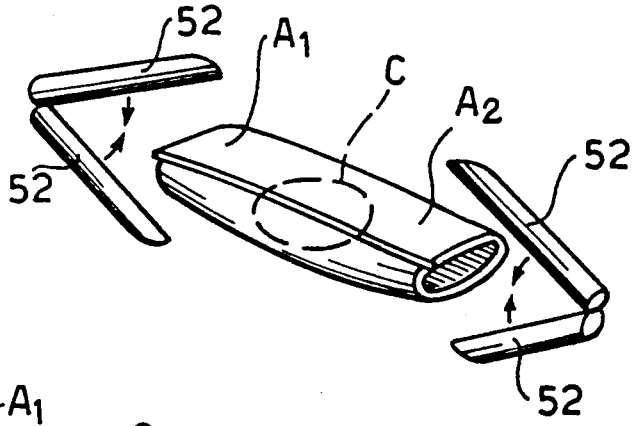

The folding of the second flap of the sheet F by the fixed folding element 46 (FIG. 11) completes the stage in which an intermediate wrapper constituted substantially by a cylinder or tube of sheet material F rolled around the body C is formed. This intermediate wrapper generally includes a central part surrounding the body C and two end parts $A_1$, $A_2$ arranged in positions facing the pincers or hands 47 (FIG. 14).

Figure 12:
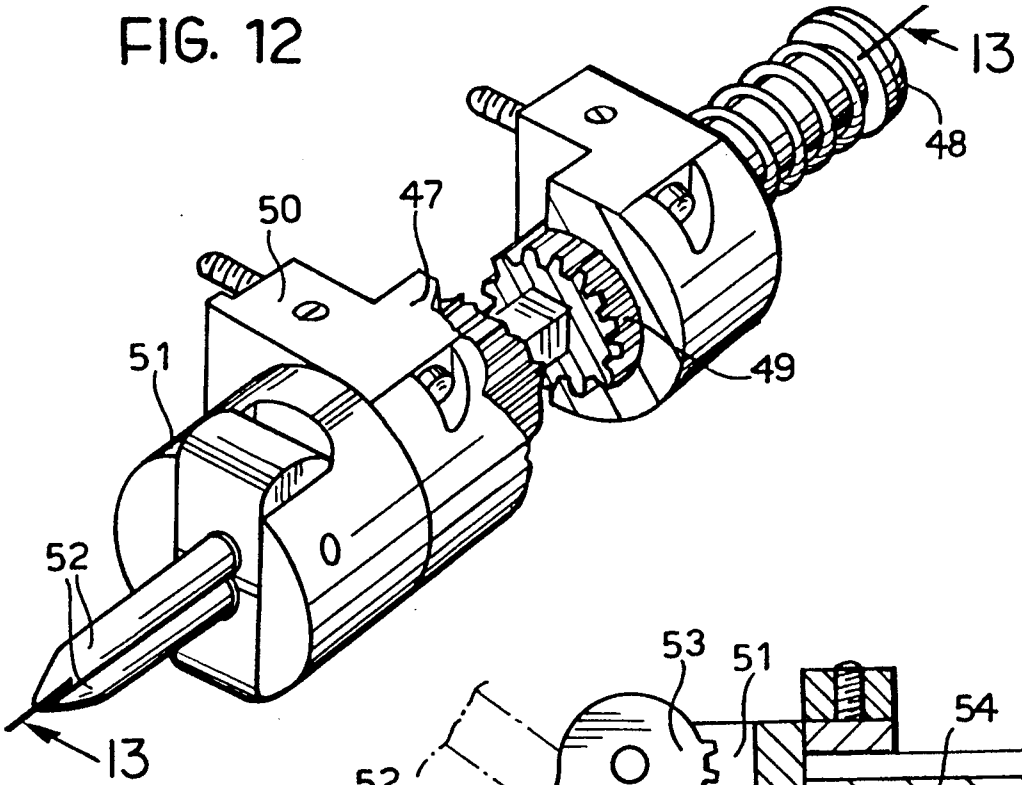
FIG. 12 shows, in greater detail, the structures of some elements visible in FIG. 5.
Figure 13:
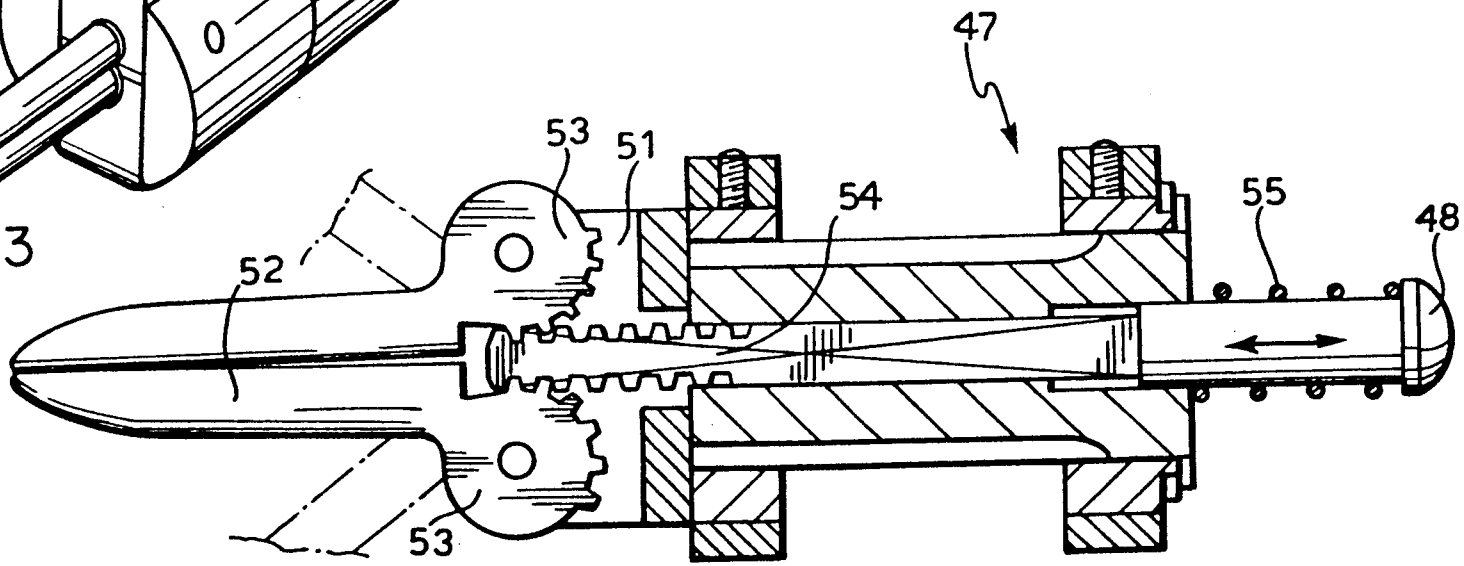
FIG. 13 is a section taken on the line XIII—XIII of FIG. 12, and FIGS. 14 and 15 show two further operating stages of the machine according to the invention.

As can be seen better in FIGS. 12 and 13, each of these pincers or hands, which are arranged like a carousel around the drum 9, is constituted essentially by a support 50 fixed to the drum 9 and housing a rotation device 51 mounted for rotation about an axis lying along one of the generatrices of the drum 9. At its inner end, that is, at the end which faces towards the clamping region of the jaws 39 and thus towards the opposite hand 47, the rotary device carries two fingers 52 with pointed ends. The fingers 52 can move between a generally opened-out position, shown in continuous outline in FIG. 5 and in broken outline in FIG. 13, and a closed clamping position, shown in continuous outline in FIGS. 12 and 13.

The pivoting movement of the fingers 52 is achieved in a coordinated manner as a result of the meshing of respective toothed sectors 53 mounted on each of the fingers 52 with a toothed rod 54. The latter extends axially within the rotary device 51 and can slide longitudinally as a result of the movement of the thrust member 48.

A biasing spring 55 acts between the body of the movable device and the head of the thrust member 48. This urges the thrust member 48 outwardly of the hand 47, causing a corresponding biasing of the fingers 52 towards the clamping position.

The movable device 51 and the fingers 52 mounted thereon are rotated by the meshing of the gear 49 with respective toothed driving sectors arranged within the drum 9 and therefore not explicitly shown in the drawings.

Figure 15:
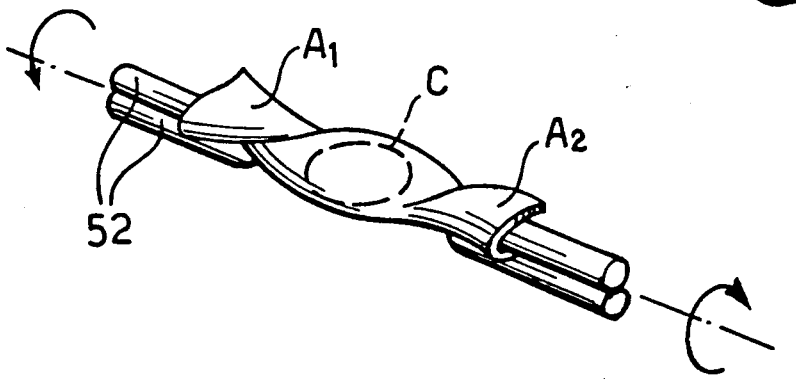

As shown schematically in FIGS. 14 and 15, the function of the fingers 52 is substantially to be clamped onto the ends $A_1$, $A_2$ of the previously-formed intermediate wrapper so as to catch these end parts firmly and then, as a result of the rotation of the devices 51, to impart thereto a general rotary movement which leads to the formation of two bow-like twists.

The movable devices 51 are preferably rotated through an angle of approximately 540° (one and a half turns) from the position in which they grip the ends $A_1$, $A_2$.

The wrapping of the bodies C is completed by the formation of the bow-like end twists by the hands 47 and, once the bodies are released by the fingers 52 which move apart as a result of a pressure exerted by cam means (not shown) on the respective thrust members 48 immediately downstream of the region in which the wrapping movement takes place, they fall into the collecting box 10 beneath the machine 1.

Naturally, the extent of the twisting movement of the end bows may be selected differently in dependence on the deformability and elastic memory characteristics of the material constituting the wrapping sheet F.

I claim:

1. A wrapping machine for wrapping preformed articles such as pieces of candy in wrapper cut from sheet material in which each article is positioned in a central portion of a wrapper which is then wrapped around the articles, and in which ends of each wrapper are gripped by rotary pincers and twisted to form corresponding bow like end twists, the machine having means for individually feeding the pieces of candy to be wrapped to a conveyor for conveying the pieces of candy while being wrapped, means for cutting individual wrappers from a roll of sheet material, means for associating one individual wrapper with one piece of candy, means for gripping each individual piece and folding an associated wrapper around it while moving on the conveyor, movable rotary pincer means for twisting the ends of each wrapper, and means for discharging the wrapped piece, with improvements comprising:

a plurality of plates carried by the conveyor, each plate having a recess generally larger than the shape of an individual piece to be wrapped plus elongated extensions, a biased thrust member positioned in the recess and shaped to receive an individual piece in a central cell portion thereof while having two opposite side flanges, each plate also having grooves separate from the recess and on opposite sides thereof, a source of vacuum connected to the grooves, vacuum from the source and surfaces of the plate acting to hold an individual wrapper on a piece positioned in the cell to keep the piece safely in the cell until the piece is wrapped and to accurately and correctly position the wrapper relative to the piece, and wherein the conveyor means has an upper and a lower horizontal run, the means for feeding the individual pieces is positioned adjacent the upper run and the wrapping of the pieces is accomplished while on the lower run of the conveyor.

2. A machine as in claim 1 wherein the grooves are comb-like in shape.

3. A machine as in claim 1 wherein there are two sets of plates, one on each side of a center line of the conveyor.

* * * * *